US009314112B2

(12) United States Patent
Chuah

(10) Patent No.: US 9,314,112 B2
(45) Date of Patent: Apr. 19, 2016

(54) BABY CARRIER WITH REMOVABLE SEAT

(71) Applicant: Khai Gan Chuah, Austin, TX (US)

(72) Inventor: Khai Gan Chuah, Austin, TX (US)

( * ) Notice: Subject to any disclaimer, the term of this patent is extended or adjusted under 35 U.S.C. 154(b) by 84 days.

(21) Appl. No.: 14/247,406

(22) Filed: Apr. 8, 2014

(65) Prior Publication Data

US 2015/0282639 A1 Oct. 8, 2015

(51) Int. Cl.
*A45F 3/04* (2006.01)
*A47D 13/02* (2006.01)

(52) U.S. Cl.
CPC ..... *A47D 13/025* (2013.01)

(58) Field of Classification Search
CPC ... A47D 13/02; A47D 13/025; A47D 15/006; A45F 3/08
See application file for complete search history.

(56) References Cited

U.S. PATENT DOCUMENTS 4,009,808 A * 3/1977 Sharp ..... A47D 13/025 224/160
4,271,998 A * 6/1981 Ruggiano ..... A47D 13/025 224/160
4,458,834 A * 7/1984 Rosen ..... A47D 13/025 224/159
4,579,264 A * 4/1986 Napolitano ..... A47D 13/025 224/158
4,718,715 A * 1/1988 Ho ..... A47D 13/025 224/155
4,901,898 A * 2/1990 Colombo ..... A47D 13/025 224/159
4,941,604 A * 7/1990 Nagareda ..... A47D 13/025 224/160
5,020,709 A * 6/1991 Hoaglan ..... A47D 13/025 224/155
5,178,309 A * 1/1993 Bicheler ..... A47D 13/025 224/153
5,224,637 A * 7/1993 Colombo ..... A47D 13/025 224/158
5,230,450 A * 7/1993 Mahvi ..... A45C 7/0045 190/108
5,791,535 A * 8/1998 Roan ..... A47D 13/025 224/153
6,019,510 A * 2/2000 Gonzalez ..... B60R 7/043 224/409
6,098,857 A * 8/2000 Le Gal ..... A47D 13/025 224/153
6,789,710 B1 * 9/2004 Szatkowski ..... A47D 13/025 224/159
7,510,104 B2 * 3/2009 Taylor ..... A45F 3/00 224/153
8,172,116 B1 * 5/2012 Lehan ..... A45F 3/04 224/159
2005/0045675 A1 * 3/2005 Redlinger ..... A47D 13/025 224/161
2005/0051582 A1 * 3/2005 Frost ..... A47D 13/025 224/160
2005/0184114 A1 * 8/2005 Hoff ..... A47D 13/025 224/160
2007/0235479 A1 * 10/2007 Bangert ..... A47D 13/025 224/159
2007/0246493 A1 * 10/2007 Kernkamp ..... A45F 3/14 224/159
2008/0283559 A1 * 11/2008 Parness ..... A47D 13/025 224/159
2012/0241487 A1 * 9/2012 Zack ..... A47D 13/025 224/576

* cited by examiner

*Primary Examiner* — Brian D Nash

(57) ABSTRACT

The present invention relates to a baby carrier consisting of shoulder straps and a main panel. The lower aspect of the main panel consists of a seat compartment with a belt around the waist to secure the baby in place. The purpose of the seat compartment is to fit a seat insert to receive the baby's weight when being carried in the carrier. The waist belt can also be attached to and detached from the main panel with the seat compartment by way of an interlocking mechanism. The seat compartment can also be part of the waist belt that can be attached to and detached from the main panel, by way of the interlocking mechanism, so that in can be used independently from the carrier as a seat support. The seat insert can be extended further into the main panel in form of a back rest, to create more support for the baby.

19 Claims, 13 Drawing Sheets

-- PRIOR ART --

BABY CARRIER WITH REMOVABLE SEAT

BACKGROUND OF THE INVENTION

1. Field of the Invention

This invention relates to a baby carrier with means to accommodate a seat insert to improve seating comfort for baby.

2. Discussion of Prior Art

The classic baby carrier consists of a main carrier, shoulder straps and waist belt connected together to accomplish its usability. There is a general concern around the notion of using baby carriers that do not have sufficient width along the bottom aspect of the panel, of which the baby's weight is being suspended. Baby carriers with crotch suspensions are being penalized for their lack of hip support causing a mechanical anomaly called hip dysplasia. These carriers with narrow suspensions also cause obstruction of blood flow to the legs when they are being dangled downwards near the hip region. Wider crotch support carrier, provides a better support to the hips. However, the weight of the baby is consequently transferred to the sacrum and the mid thighs of the baby. As the baby grows bigger and heavier, the suspension-type support of the carrier begins to add discomfort to the baby. While being suspended, most of the added weight is centered on the sacrum, creating unnecessary stress on the sacroiliac joint of the baby. As the baby grows, the edges of main panel that cradles the baby's bottom travels closer towards the hip region. This creates a blood flow obstruction along the posterior thigh as the lower leg dangles downward with more weight. The suspension, therefore, creates an uncomfortable seating for the baby. This problem is accentuated when the baby is in a front facing position.

A solid seat added to the baby carrier will assist with improving the weight support for the baby. The added solid seat will create a better sitting posture for the baby by providing a better pelvic and spine alignment as the baby goes through the neuro-musculoskeletal development phase.

SUMMARY OF INVENTION

The present invention relates to a baby carrier consisting of shoulder straps and a main panel. More related to the invention, the lower aspect of the main panel consists of a seat compartment. The seat compartment can be part of the main panel or part of the waist belt construction. The purpose of the seat compartment is to fit a seat insert to support the baby's weight when being carried in the carrier, promoting better support and alignment of the pelvis and spine. The seat compartment can be further secured onto the user by way of a waist belt, to reduce excess movement of the baby during carrying. Further weight distribution can also be achieved with a waist belt consisting of lumbar support.

The seat compartment can be fitted into the main panel as part of the main panel or be attached to the main panel by an intricate interlocking mechanism, to become removable. The interlocking mechanism can be of any fitting locking systems such as Velcro, buckle, buttons, zippers and loop hook. The interlocking mechanism can also be spread out onto various locations throughout the lower panel at different positions, to reach the optimal suspension. A waist belt is further extended to the ends of the seat compartment of the maw panel to further secure the carrier to the user.

In another embodiment of the invention, the waist belt, in its entirety, can also be attached to and detached from the main panel using the interlocking mechanism. By having this type of system, it allows a variety of waist belts of different size and types to be attached to the carrier to fit the user. Waist belts can be of different sizes and designs to fit the user, medically or cosmetically. Waist belts can also have lumbar supports to provide a better weight distribution of baby throughout the user's back, to minimize back strain.

In another embodiment, the seat compartment can also be part of the waist belt construction, with an interlocking mechanism to attach to the bottom of the main panel. With this design, the waist belt with seat compartment can be used with the main panel, or be used independently as a seat support for the baby to be carried in the front or the side of the user.

Another embodiment of the invention is that the seat insert can be extended farther into the main panel in form of a full or partial back rest, to create more support for the baby.

Once the seat is removed, the baby carrier can be used as a normal, traditional carrier. The seat can be of any shape, size and design; and can be hollow for storage, or simply as means to reduce the weight of the seat.

DETAILED DESCRIPTION OF INVENTION

Figure 1:
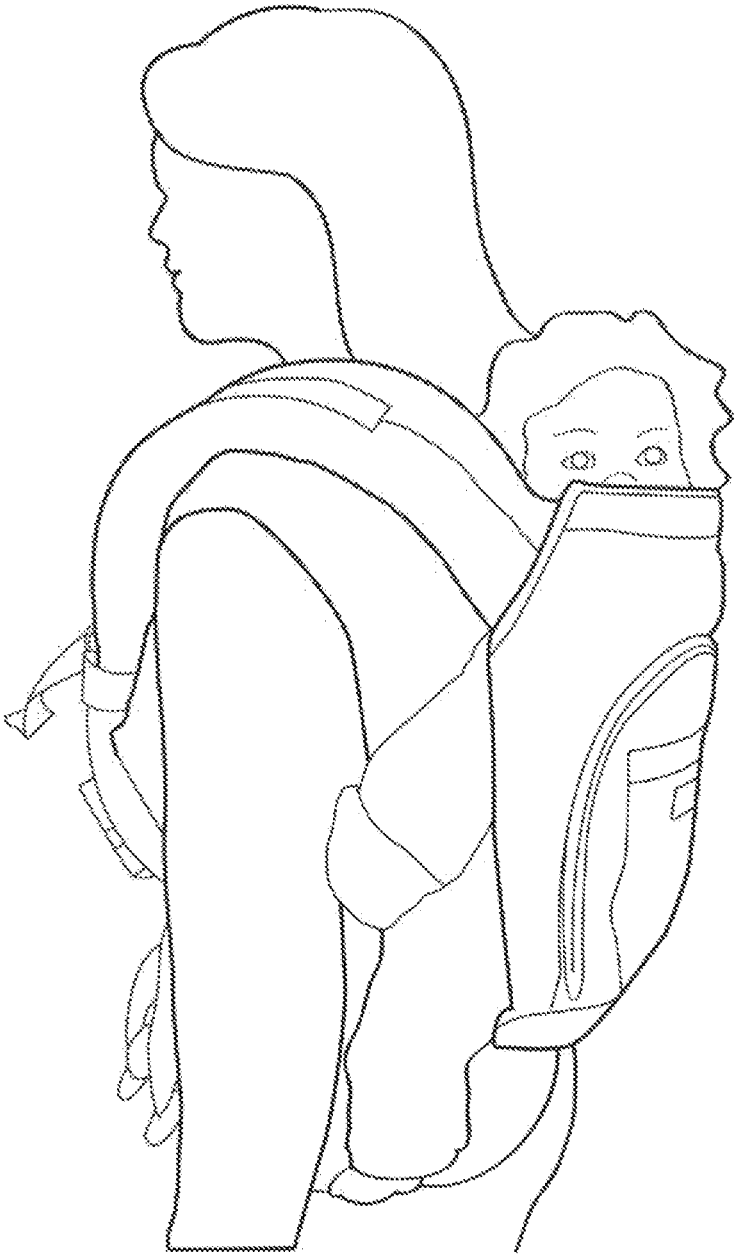
FIG. 1 is a perspective view of a traditional baby carrier, shown being mounted upon the back of a user with a baby seated in the carrier.
Figure 2:
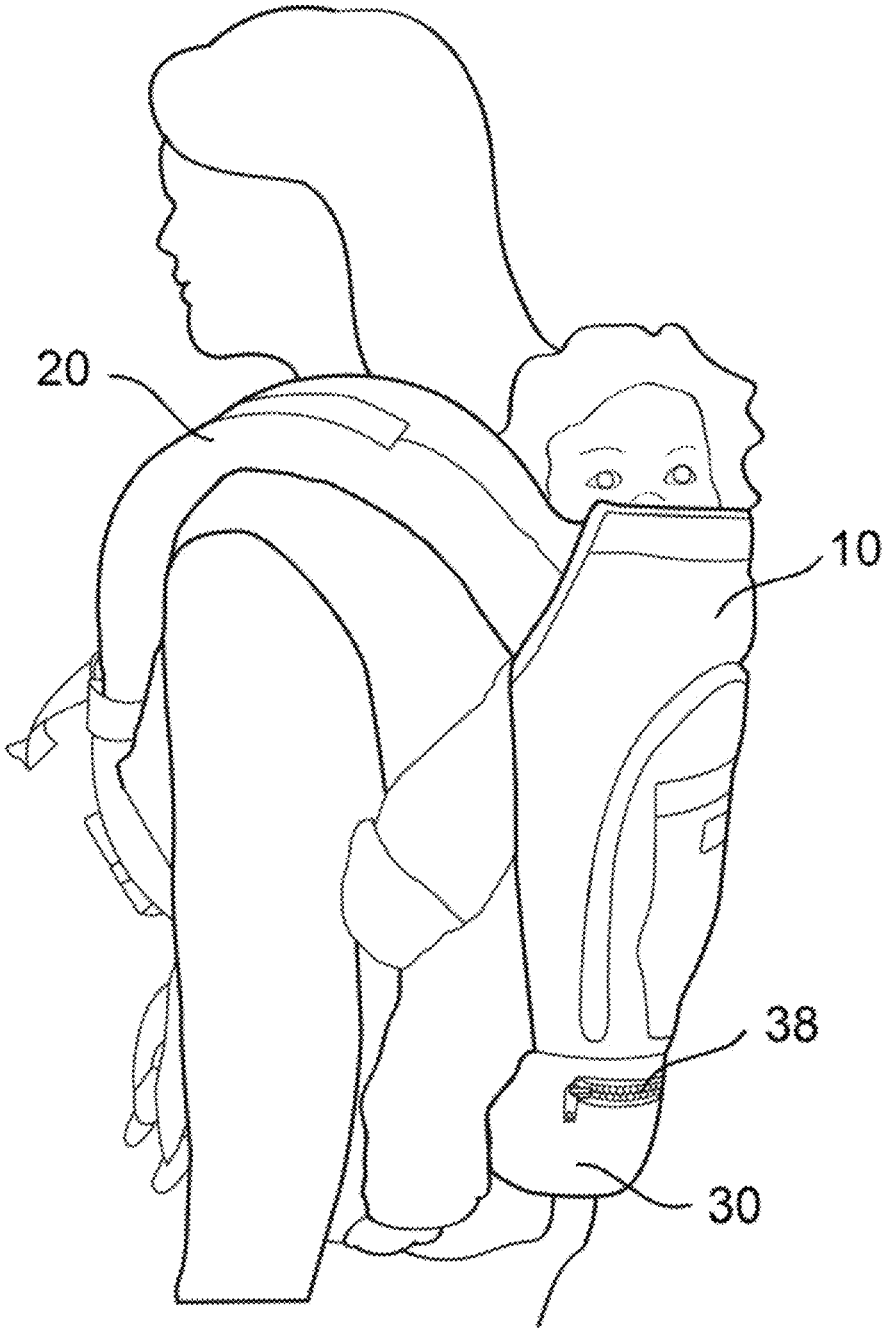
FIG. 2 is a perspective view of a baby carrier with the seat compartment of the present invention, shown being mounted upon the back of a user with a baby seated in the carrier.

The present invention relates to a baby carrier with a seat insert. Traditional baby carrier comes without seat compartment as shown in FIG. 1. For this invention, the general parts of the baby carrier comprise of a main panel 10 and shoulder straps 20. The lower aspect of the main panel 10 consists of a seat compartment 30, shown in FIG. 2. The said compartment 30 is either part of the main panel 10, shown in FIG. 2; or an attachment to the said main panel 10 by way of an interlocking system. The alternate embodiments of the said compartment being an attachment to the main panel 10 will be discussed later.

The main panel is, to a certain extent, a multi-sided shaped fabric with flexibility to conform to the baby's torso during use. The main panel is also sturdy and tough to withstand the weight of baby and wash ability. The main panel can also comprise of breathable mess materials to allow ventilation, as well as multiple layers for heat insulation. The upper corners of the said main panels consist of attachments to the shoulder straps. Together, the main panel and shoulder straps operates as a sling to cradle the baby against the user's body.

More related to this invention, the lower aspect of the main panel consist of a compartment 30. The purpose of the seat compartment 30 is to enclose a seat insert 40, shown in FIG. 5, for means of providing a seat support for the baby while being carried. Naturally, to secure the said seat insert in its place, the seat compartment 30 will consist of a fastener 38, by ways of a zipper or any kind, of fastener that deem appropriate to approximate the opening.

Figure 3:
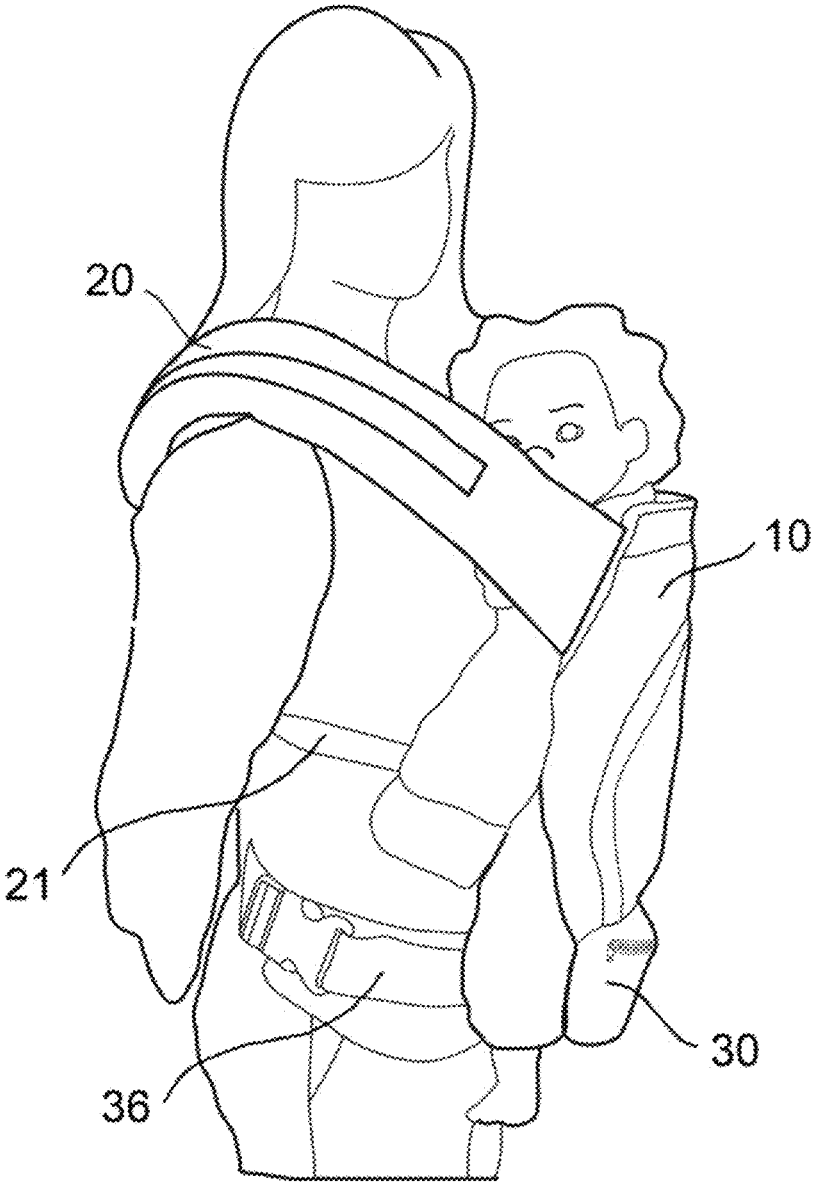
FIG. 3 is a perspective view of a baby carrier with the seat compartment of the present invention, shown being mounted upon the front of a user with a baby seated in the carrier.
Figure 4:
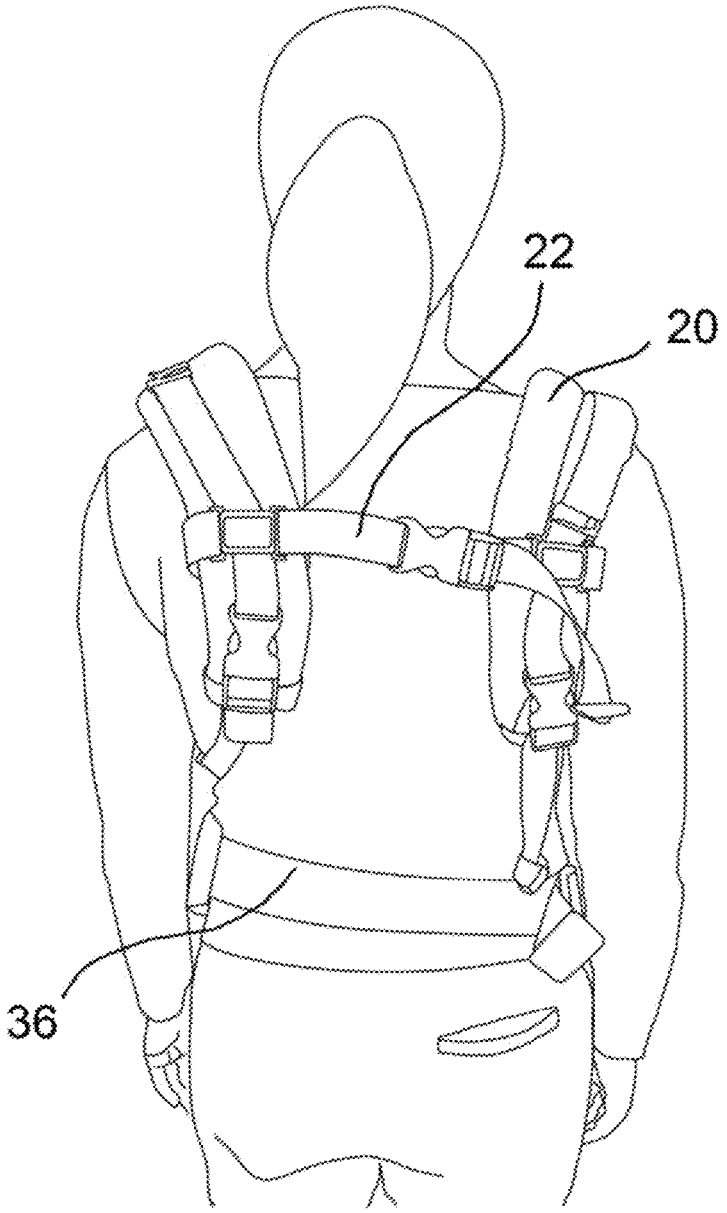
FIG. 4 is a perspective view of shoulder and back strap configurations of baby carrier, shown being mounted in the front-carrying position.

The baby carrier can also be in a front carrying position with the seat compartment 30 resting, comfortably on the user's abdomen, shown in FIG. 3. The said seat compartment can be further secured onto the user by way of a waist belt 36. The waist belt is shown in FIG. 3 and FIG. 4. The said waist, belt 36 is comfortably strapped around the user's waist to keep the baby in position. It can also further aide in distributing, the baby's weight throughout the user more evenly to prevent back and shoulder strain. The said waist belt 36 can be padded to add more comfort to the user. The said waist belt 36 consists of a fastener mechanism at each ends to fasten around the waist of the user.

The shoulder straps 20 are displaced, in general, around the corners of each top edges of the main panel 10. The pair of said shoulder straps 20 is adequately padded to reduce pressure and strain on the user's shoulder while using, the carrier. Where each padded shoulder strap 20 is attached to the main panel, a belt strap 21 is attached below it, along, the same side of the main panel 10. Each padded shoulder strap 20 will have one end attached to the top side corner of the main panel 10, and then loops around to have the other end meet the belt strap 21.

Fasteners are used to connect the padded shoulder straps 20 and the belt straps 21. These fasteners such as, but not limited to, the buckle style, can adjust the length of the shoulder straps looped around the users. The fastener arrangements of can be seen in FIG. 4. Additional straps, such as the shoulder cross straps 22 shown in FIG. 4 can be added to prevent the shoulder straps 20 from sliding down the arms of user. FIG. 4 shows a typical method the straps and waist belt are fastened together when using the carrier in a front carrying position, in general, these straps are fastened to each other by a fastening system that is easy to engage, and provide a means of length adjustments to the straps. The fasteners straps and belts can be attached to the main panel by way of a connector such as using Velcro, button, hooks, loops and buckle.

Figure 5:
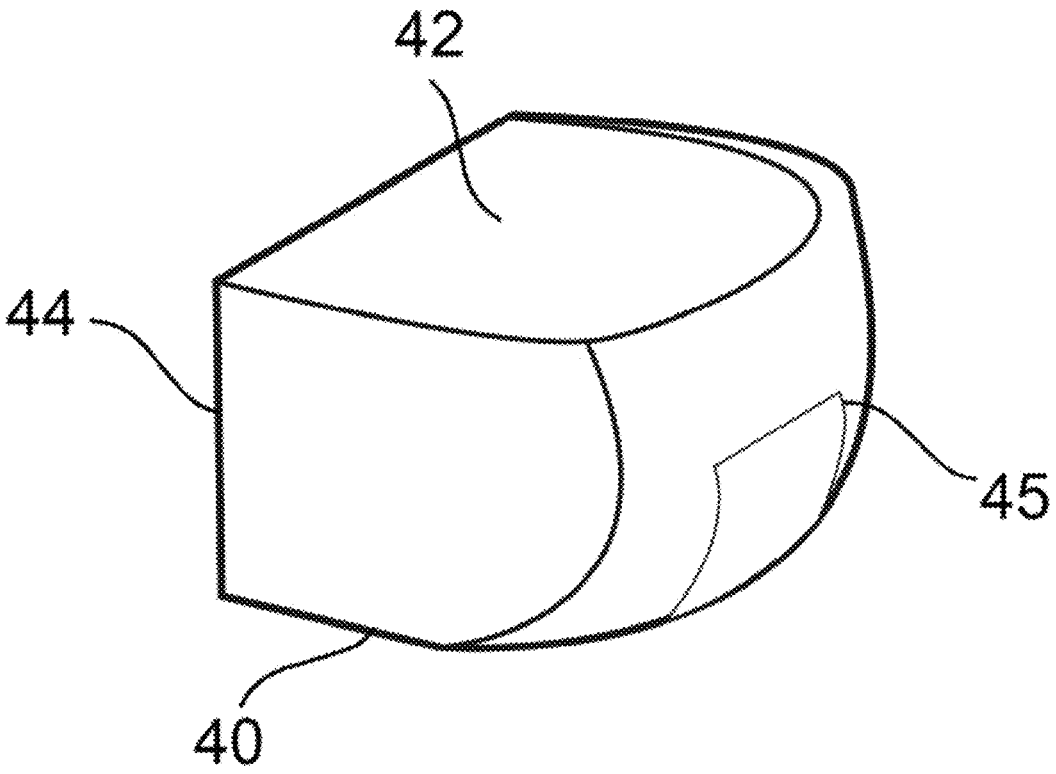
FIG. 5 is a perspective view of the seat insert.

Closer examination of the seat insert 40 in FIG. 5 reveals the seat with its top surface 42 contoured to baby's bottom for natural sitting posture, and the inner surface 44 contoured to fit the back and abdomen of a user. It is to be noted that the seat insert 40 is of a lightweight material to reduce the added weight to the carrier as much as possible. It is also noted that the seat insert can be made of materials with means to produce a light weight seat that has adequate flexibility to provide comfort for the baby and user. These materials may carry properties that include, but not limited to, rigid, semi-rigid, flexible, gel-type, foam-type material. The shape, design and material of the seat insert 40 are determined based on the goals to; improve the comfort of the baby, achieve weightlessness and provide seat durability and hygiene. It is also to be noted that the seat insert can also be hollow to achieve lighter weight. The hollow seat can also be adapted as a storage compartment, to store lightweight necessities such as baby diapers, and wipes. If designed as a storage compartment, an opening 45 is then necessary and can be adapted onto the seat insert 40 shown in FIG. 5, as an example.

Figure 6:
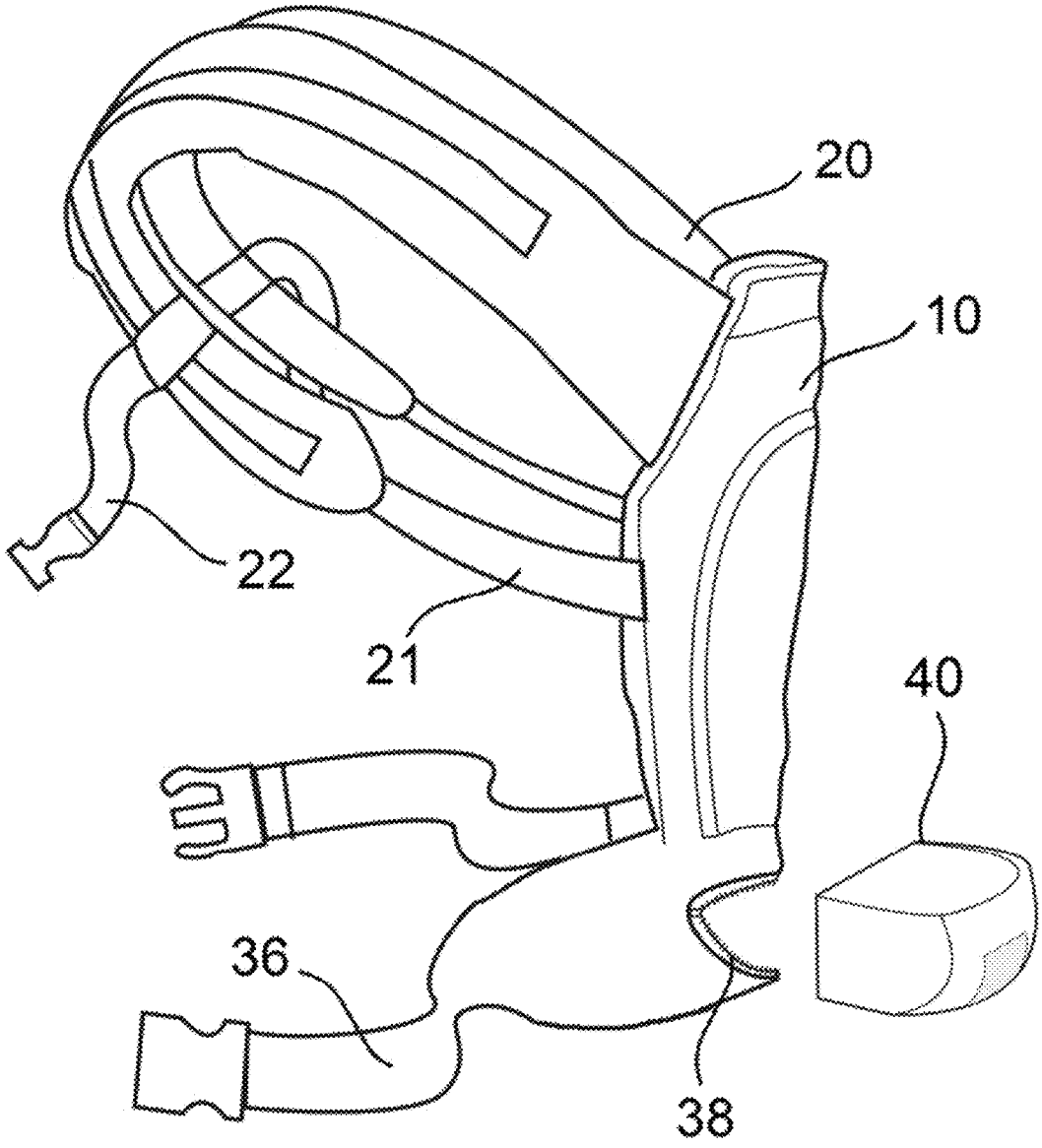
FIG. 6 is a lateral view of baby carrier showing the opening of the seat compartment to receive the seat insert.
Figure 7:
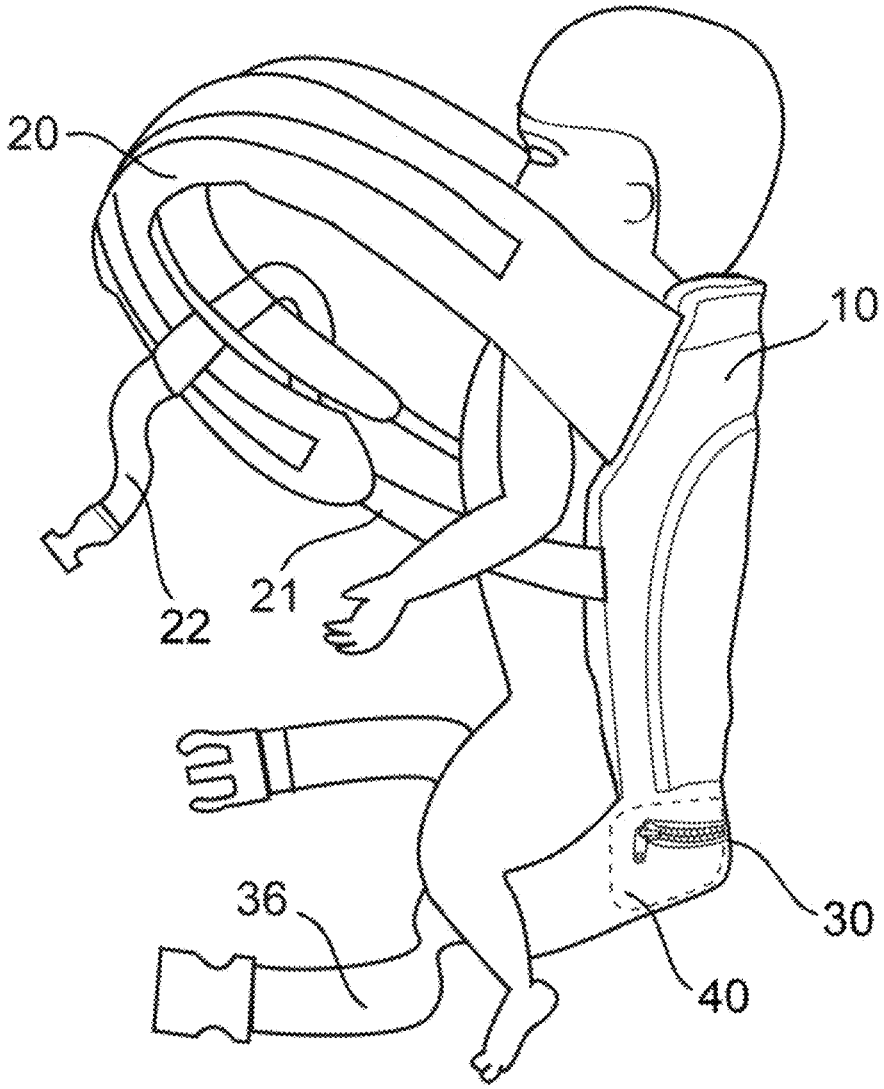
FIG. 7 is a lateral view of the baby seated in the carrier with the seat insert underneath.

The seat insert 40 is placed in the seat compartment 30 located at the lower aspect of the main panel 10 by way of an opening, prior to the baby carrier being used, shown in FIG. 6. The seat insert is secured in place with a fastener 38. FIG. 7 shows the position of the seat insert 40 on the baby carrier. When fitted correctly, the baby's bottom and back is aligned with the seat. This allows a more natural sitting posture, by aligning the spine and pelvis of the baby in a more neutral position, shown in FIG. 7. Without the seat insert 40, the baby is generally forced into a slouched position, where the baby's spine is curved, creating abnormal strain on the ligaments of the spine of the baby. With the seat insert 40, the weight of the baby is support by the seat insert, instead of suspended by the main panel 10.

Figure 8:
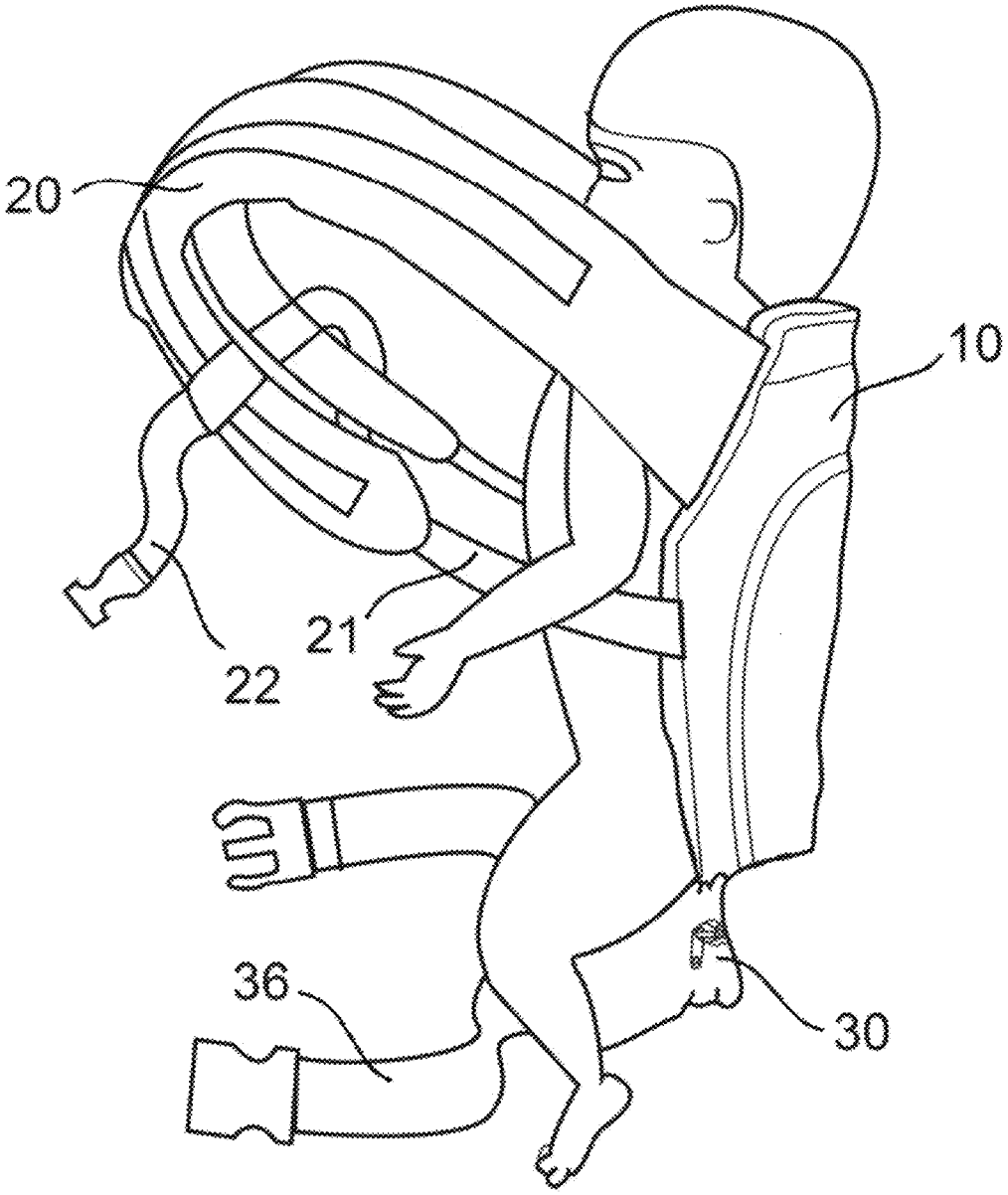
FIG. 8 is a lateral view of the baby seated in the carrier with the seat insert removed.

It is to be noted that when the seat insert 40 is not installed in the seat compartment, the baby carrier can be used like a traditional carrier. This is shown in FIG. 8.

Figure 9A:
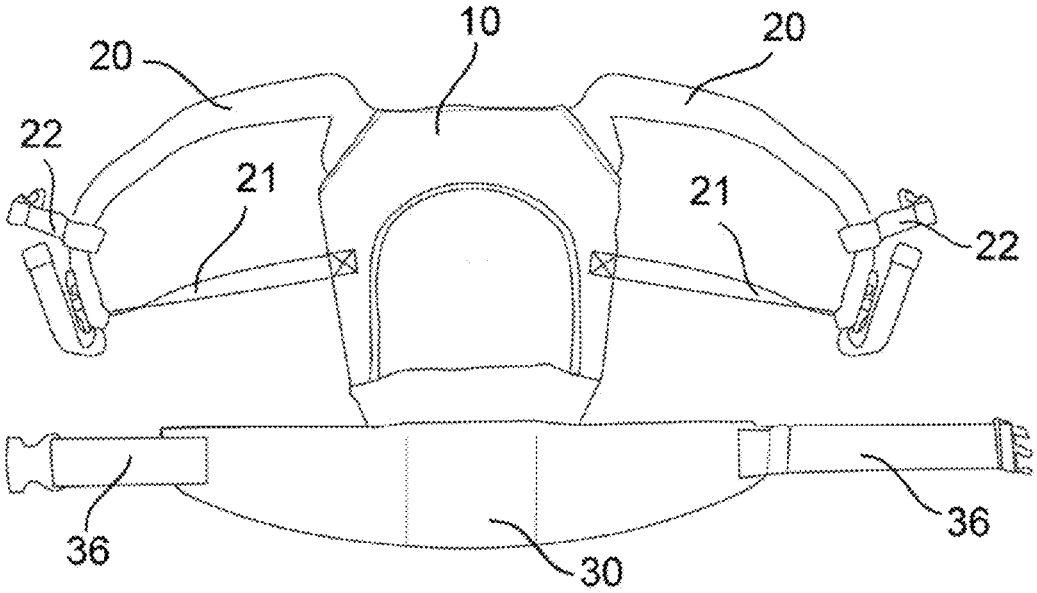
FIG. 9A is the front view of the baby carrier with the seat compartment of the present invention.
Figure 9B:
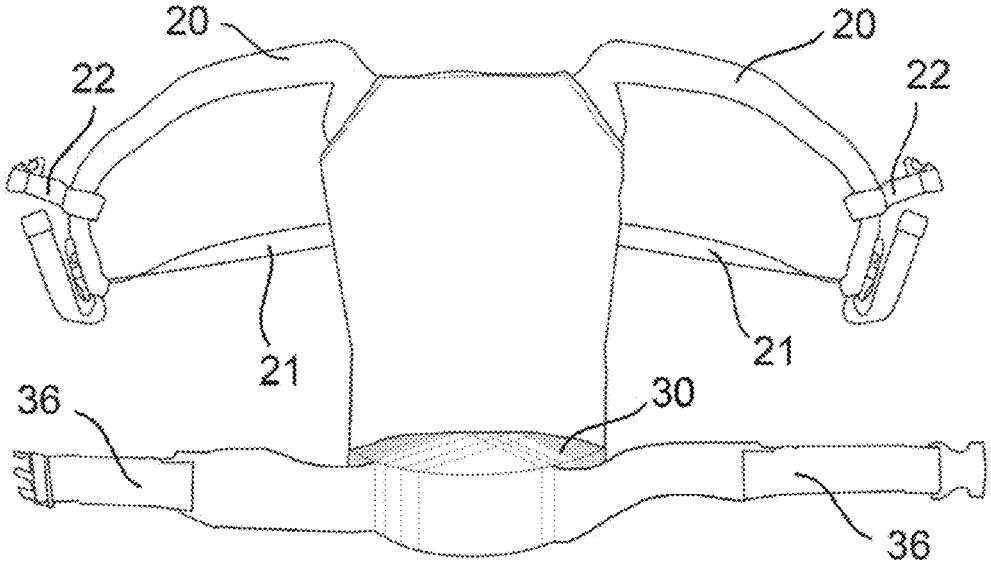
FIG. 9B is the rear view of the baby carrier with the seat compartment of the present invention.

FIG. 9A and FIG. 9B is front view and back view of the baby carrier, respectively. The attachments of the padded shoulder straps 20 and their respective belt straps 21 on the main panel 10 are shown more clearly. The main panel 10, with its top two corners cut out for the attachments of the padded shoulder straps 20, has the belt straps 21 attached to its side borders. The padded shoulder straps 20 and belt straps 21 are conjoined by fasteners that allow adjustments to the length of the belt straps. A pair of shoulder cross straps 22, with adjustable length can be added to the shoulder straps 20 to hold the shoulder straps together to prevent the shoulder straps from sliding off the user's shoulders. The lowest aspect of the main panel 10 is the seat compartment 30 with waist belts 36 attached to either sides of the said seat compartment 30.

Alternate Embodiments

Figure 10:
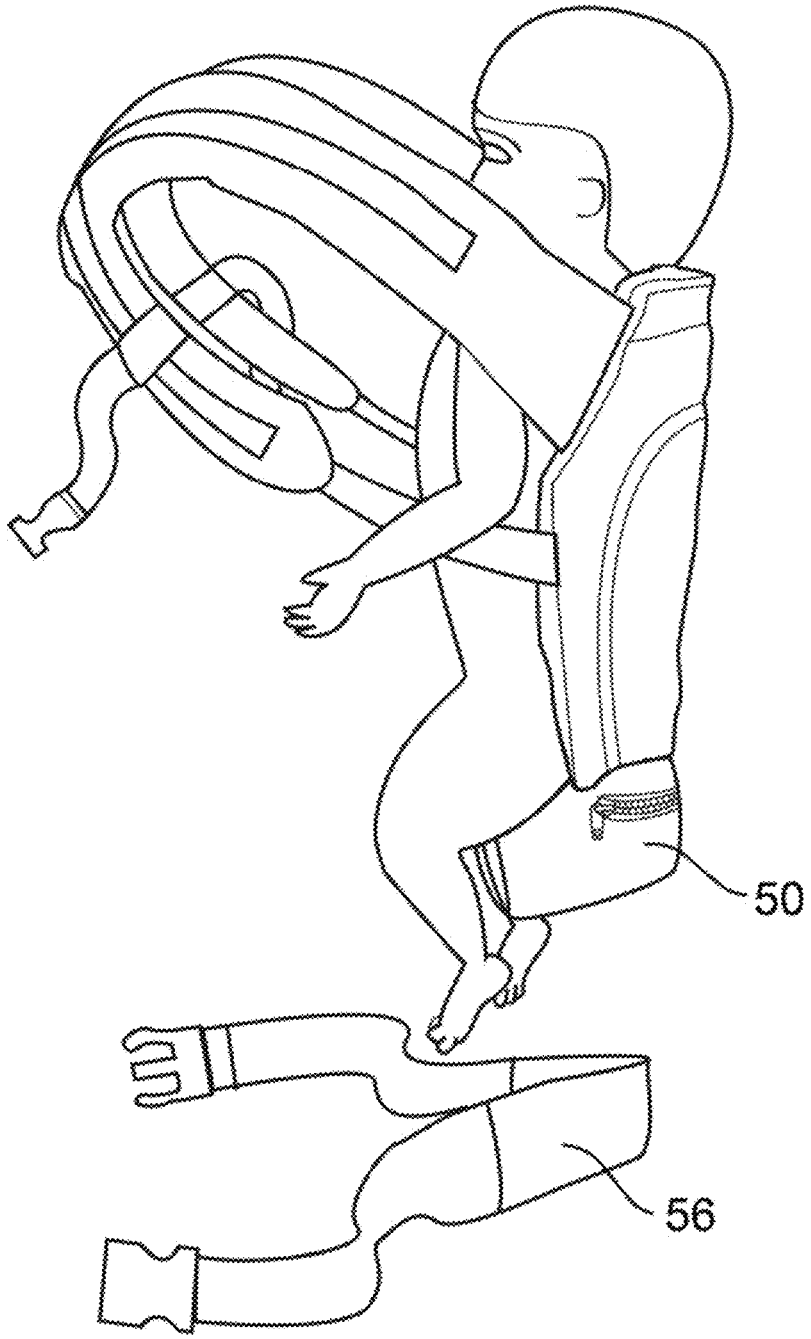
FIG. 10 is the lateral perspective view of a baby carrier with the seat compartment of the present invention, shown with a baby seated in the carrier and waist belt being detached.

It is to be noted that an alternate embodiment to the intervention wherein the waist belt 56 can be removed from the main panel 10, shown in FIG. 10. Naturally, the said waist belt 56 can be attached to seat compartment 50 which is part of the main panel via an interlocking system. The interlocking system can be attached to the main panel by way of a connector such as using Velcro, button, hooks and buckle or inserted via a loop extended from main panel 10. This is beneficial when more design choices of the waist belt can be attached onto the baby carrier to better fit the individual user or baby.

Figure 11A:
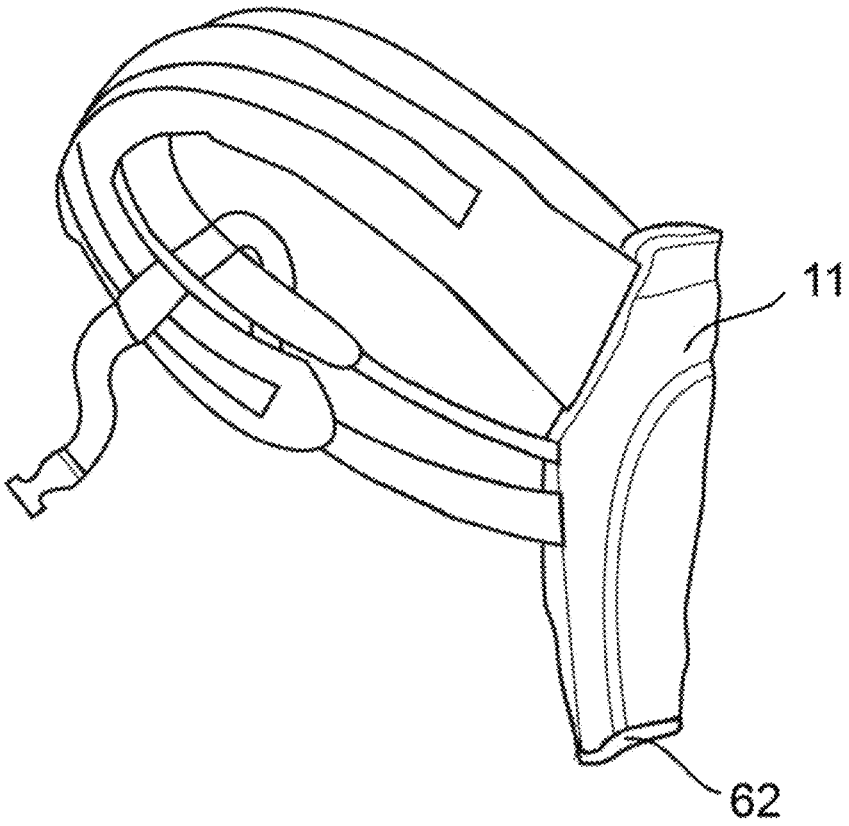
FIG. 11A is the lateral perspective view of the seat compartment as part of the waist belt detached from main panel.
Figure 11A:
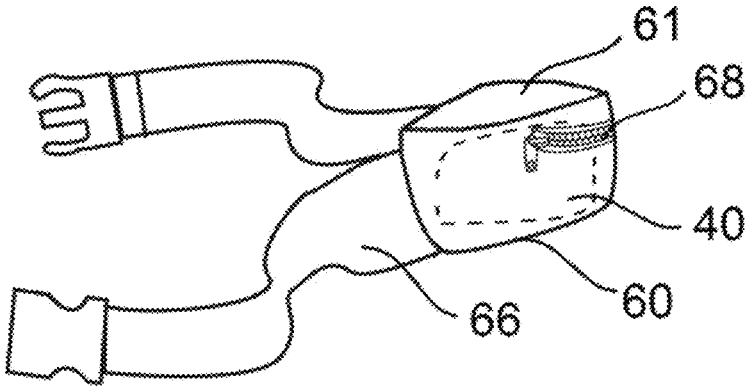
Figure 11B:
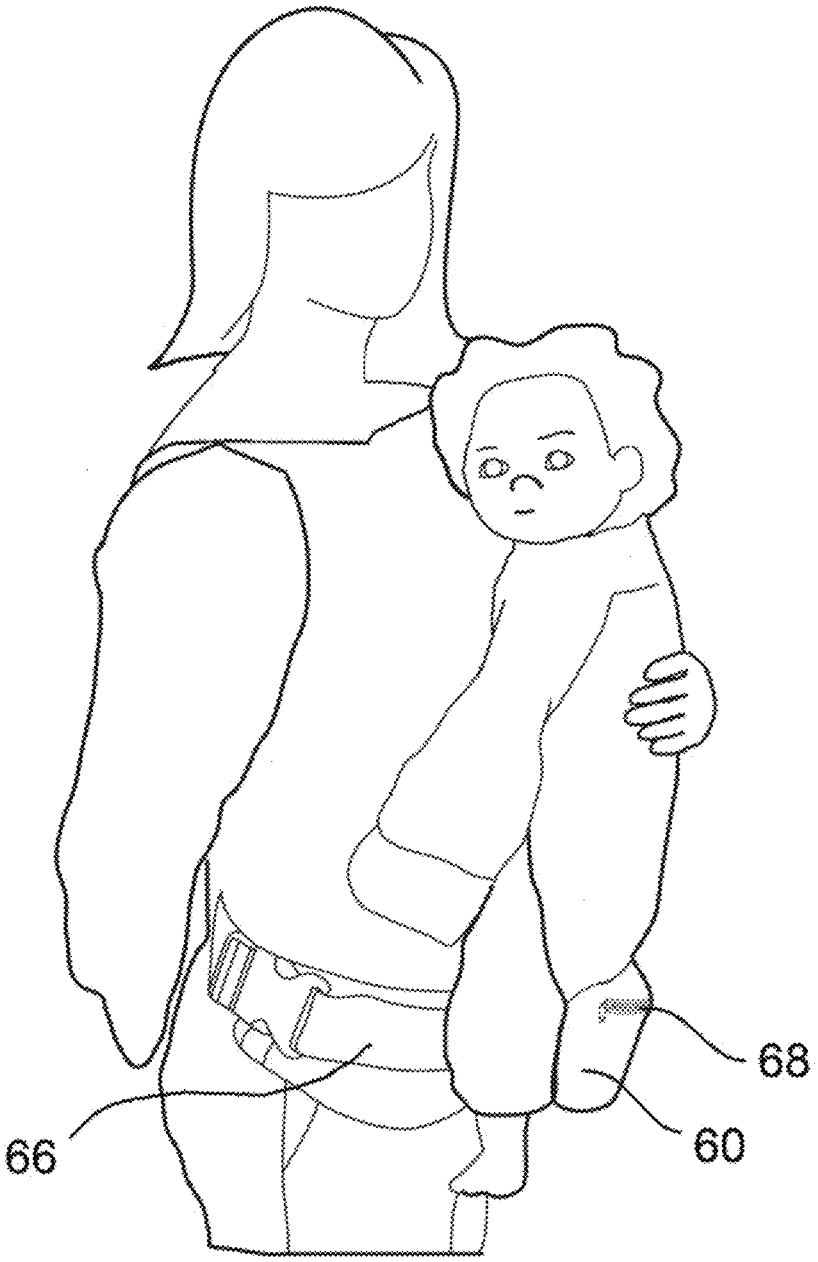
FIG. 11B is a perspective view of the waist belt with the seat compartment used independently without the main panel.

Another embodiment of the invention, shown in FIG. 11A, wherein the seat compartment 60 is part of the waist belt 66. The seat compartment 60 can be attached to or detached from the main panel 11 by way of an interlocking system. The interlocking system can be positioned on surface 61 or along the edges of the said seat compartment 60, with means to conjoin at the bottom surface 62 of main panel 11 way of a connector such as using Velcro, button, hooks and buckle. The said seat compartment 60 would enclose the seat insert 40; with a fastener 68 allowing the seat insert 40 to be placed in and removed easily. With this alternate embodiment, the waist belt 66 can be used independently as a seat support for the baby while being carried in the front or at the side, as shown in FIG. 11B.

Figure 12:
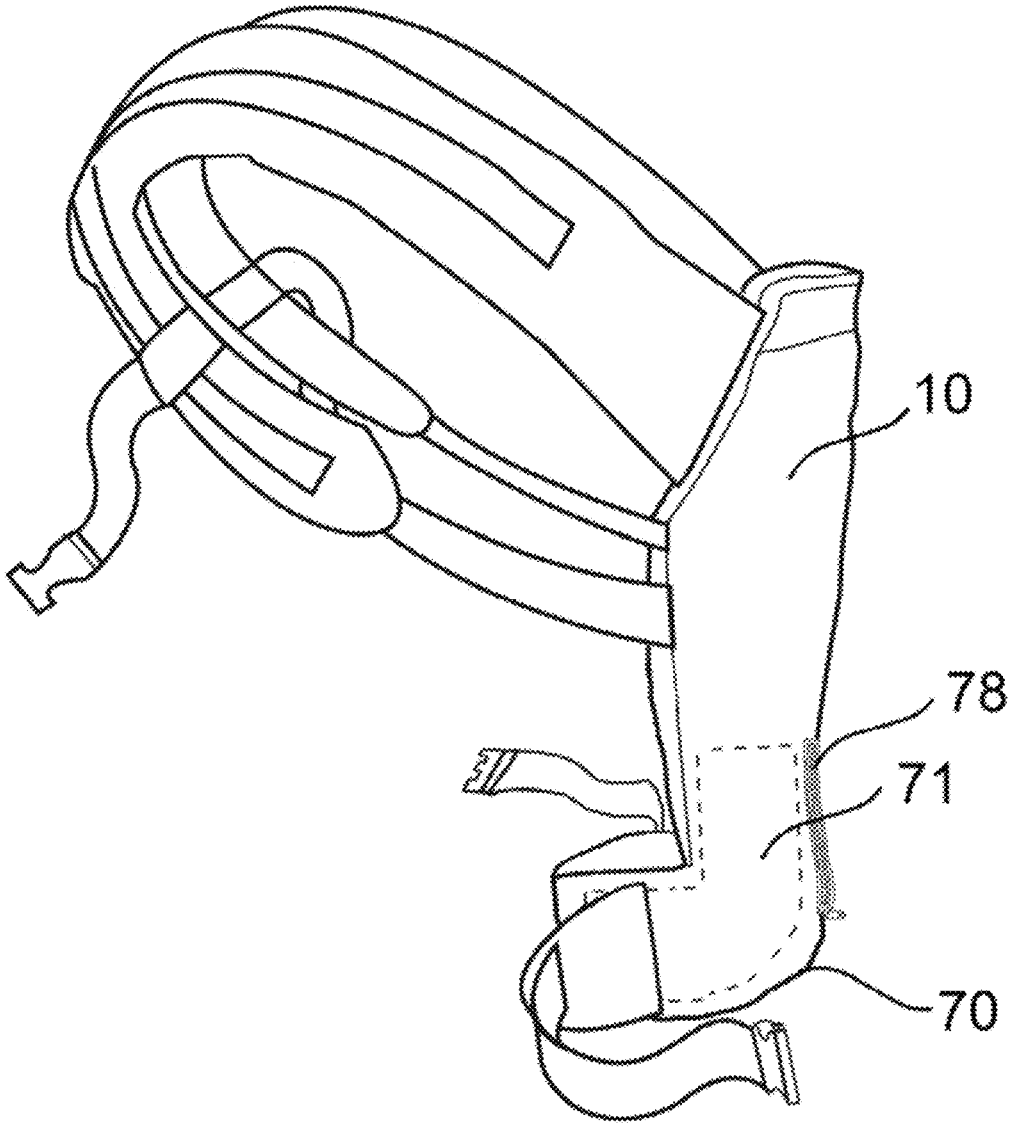
FIG. 12 is another embodiment of the baby carrier, with the seat compartment being extended to accommodate the seat insert to include a back rest.

It is to be noted that another alternate embodiment of the seat insert can be designed to have additional back support inserted into the main panel 10, as noted in FIG. 12. The seat with back support 71 can provide, especially to babies with special needs, a stronger trunk support and better alignment of spine and pelvis. As an option, the seat with back support 71 has an opening for storage purposes. The seat compartment. 70 naturally consists of a listener 78 by ways of a zipper or any kind of fastener that deem appropriate to approximate the opening. The said seat compartment 70 would enclose the seat insert 71; with the fastener 78 allowing the seat insert 71 to be placed in and removed easily.

What is claimed is:

1. A baby carrier comprising:

a main panel including a body and a seat compartment, the seat compartment enclosing at least one seat insert, wherein the at least one seat insert comprises a first surface for cradling the bottom of the baby and a second surface for contouring to the body of a user, and wherein the seat compartment is removably coupled to a waist belt, the seat compartment and the waist belt supporting the at least one seat insert; and a pair of shoulder straps, wherein each shoulder strap has at least one shoulder engagement segment positioned on the main panel.

2. The baby carrier of claim 1, wherein the waist belt comprises an interlocking mechanism for removably coupling the waist belt to the seat compartment.

3. The baby carrier of claim 1, wherein the second surface of the at least one seat insert is contoured to conform to the abdomen of the user.

4. The baby carrier of claim 1, wherein the second surface of the at least one seat insert is contoured to conform to the back of the user.

5. The baby carrier of claim 1, wherein the first surface comprises a horizontal surface.

6. The baby carrier of claim 1, wherein the second surface comprises a vertical surface.

7. The baby carrier of claim 1, wherein the seat compartment is hollow.

8. A baby carrier comprising:

a main panel including a body and a seat compartment, the seat compartment enclosing at least one seat insert, wherein the at least one seat insert comprises a first surface for cradling the bottom of the baby and a second surface for contouring to the body of a user;

a pair of shoulder straps, wherein each shoulder strap has at least one shoulder engagement segment positioned on the main panel; and a waist belt removably coupled to the seat compartment, wherein the waist belt comprises at least one interlocking mechanism that engages with the seat compartment, and wherein the waist belt and the seat compartment support the at least one seat insert.

9. The baby carrier of claim 8, wherein the second surface of the at least one seat insert is contoured to conform to the abdomen of the user.

10. The baby carrier of claim 8, wherein the second surface of the at least one seat insert is contoured to conform to the back of the user.

11. A baby carrier, comprising:

a body;

a seat compartment coupled to the body, the seat compartment enclosing at least one seat insert containing at least one opening, wherein the at least one seat insert comprises a first surface for cradling the bottom of the baby and a second surface for contouring to the body of a user; and, a waist belt removably coupled to the seat compartment.

12. The baby carrier of claim 11, wherein the seat insert is secured to the seat compartment using a fastener, and wherein the seat insert is removable from the seat compartment by disconnecting the fastener.

13. The baby carrier of claim 12, wherein the baby carrier is utilized for carrying a baby without the seat insert enclosed in the seat compartment.

14. A baby carrier, comprising:

a body;

a seat compartment coupled to the body, the seat compartment enclosing at least one seat insert containing at least one opening, wherein the at least one seat insert comprises a first surface for cradling the bottom of the baby and a second surface for contouring to the body of a user; and, a waist belt removably coupled to the body.

15. A baby carrier, further comprising:

a body; and, a seat compartment coupled to the body, the seat compartment enclosing at least one seat insert containing at least one opening, wherein the at least one seat insert comprises a first surface for cradling the bottom of the baby and a second surface for contouring to the body of a user, wherein the seat compartment is removable from the body.

16. A baby carrier, comprising:

a body; and, a seat compartment coupled to the body, the seat compartment enclosing at least one seat insert containing at least one opening, wherein the at least one seat insert comprises a first surface for cradling the bottom of the baby and a second surface for contouring to the body of a user, wherein the seat compartment is hollow.

17. A baby carrier comprising:

a main panel including:

a body for supporting the upper torso of the baby, a seat compartment coupled to the body, the seat compartment enclosing at least one seat insert, wherein the at least one seat insert comprises a first surface for cradling the bottom of the baby and a second surface for contouring to the body of a user, and wherein the seat compartment is coupled to a waist belt, the seat compartment and the waist belt supporting the at least one seat insert; and a pair of shoulder straps, wherein each shoulder strap has at least one shoulder engagement segment positioned on the main panel.

18. The baby carrier of claim 17, wherein the second surface of the at least one seat insert is contoured to conform to the abdomen of the user.

19. The baby carrier of claim 17, wherein the second surface of the at least one seat insert is contoured to conform to the back of the user.

* * * * *